US006566321B1

(12) United States Patent
Thekkekandam et al.

(10) Patent No.: US 6,566,321 B1
(45) Date of Patent: May 20, 2003

(54) LOW FOAMING WASHING LIQUID

(75) Inventors: Joseph T. Thekkekandam, Siler City, NC (US); Frank Lama, High Point, NC (US)

(73) Assignee: Kay Chemical, Inc., Greensboro, NC (US)

( * ) Notice: Subject to any disclaimer, the term of this patent is extended or adjusted under 35 U.S.C. 154(b) by 0 days.

(21) Appl. No.: 10/131,707

(22) Filed: Apr. 24, 2002

(51) Int. Cl.[7] ..... C11D 1/83; C11D 1/22; C11D 1/72

(52) U.S. Cl. ..... 510/424; 510/235; 510/245; 510/247; 510/254; 510/289; 510/356; 510/357; 510/365; 510/421; 510/422; 510/424; 510/426; 510/427; 510/501

(58) Field of Search ..... 510/235, 245, 510/247, 254, 289, 356, 357, 365, 421, 422, 424, 426, 427, 501

(56) References Cited

U.S. PATENT DOCUMENTS 3,869,399 A * 3/1975 Collins ..... 252/118
5,039,447 A * 8/1991 Reuben ..... 252/186.26
5,668,098 A * 9/1997 Gutierrez et al. ..... 510/350
5,798,329 A * 8/1998 Taylor et al. ..... 510/384

* cited by examiner

*Primary Examiner*—Charles Boyer
(74) *Attorney, Agent, or Firm*—Merchant & Gould, LLC

(57) ABSTRACT

A low-foaming, liquid composition is disclosed. Methods of making and using the low-foaming, liquid composition are also disclosed.

20 Claims, No Drawings

LOW FOAMING WASHING LIQUID

FIELD OF THE INVENTION

The present invention relates to a liquid composition for use with water to provide a cleaning solution for the removal of food from dishes, flatware and cookware.

BACKGROUND OF THE INVENTION

Soiled dishes, flatware and cooking utensils are normally cleaned in automatic dishwashers that confine the objects to be cleaned within a sealed container. An amount of detergent is dispensed into the container and an amount of water is added and the resulting solution is re-circulated by spray apparatus to remove the undesirable materials from the surface of the objects being cleaned.

The significant agitation of the detergent solution being used precludes the use of detergents that generate significant amount of foam. Excessive foaming of the detergent solution can cause leakage of the foam from the dishwasher. As a result, low foaming detergents are used that generate little foam. By contrast, when dishes, flatware and cookware are to be cleaned by hand by the ordinary consumer, the presence of foam is considered to be necessary to provide adequate cleaning. While the presence of foam may or may not promote cleaning, consumers engaged in the manual cleaning process consider foam to correlate with cleaning power.

The use of dishwashing detergents on metal cookware also introduces significant constraints. If the detergent is excessively basic in pH or highly alkaline, then aluminum cookware is attacked, degrading the surface of the cookware. Introduction of corrosion inhibitors may minimize the degradation of the aluminum surface; however, some corrosion inhibitors lead to other undesirable effects, such as residues and formulation constraints.

In commercial applications, "open" washing devices are used to clean dishes, flatware, and cookware. Such devices are essentially an open-topped container (i.e., a large sink-like device) having a means of agitation positioned within the device to continuously agitate and heat a detergent solution therein. Because such devices are not closed, the cleaning operation is observable by the operator. Suitable detergents for use in such a device must have adequate cleaning power without the necessity of high-pressure jets that typically are used in an enclosed system (i.e., a household dishwasher).

Known liquid detergents currently used in open washing devices possess one or more of the following shortcomings: (1) the detergent forms too much foam under agitation such that foam overflows onto the floor next to the open washing device; (2) the detergent forms too little foam under agitation such that an operator doubts whether the detergent is adequately cleaning the cookware; (3) the detergent is unsuitable for use with aluminum cookware; (4) the detergent has a viscosity, which prevents the detergent from being dispensed as a liquid, either manually or automatically; and (5) the detergent has an unacceptable shelf life, which prevents the detergent from having satisfactory commercial utility.

What is needed to the art is a low-foaming liquid detergent, which provides a controlled amount of foam during agitation in an open washing device, provides adequate cleaning power in soft as well as hard water, and is safe to use with aluminum cookware. Further, what is needed to the art is a user-friendly, low-foaming liquid detergent, which is dispensable as a liquid, either manually or automatically, and has an acceptable shelf life.

SUMMARY OF THE INVENTION

The present invention addresses some of the difficulties and problems discussed above by the discovery of an improved low-foaming liquid detergent having a unique combination of components, which results in a cleaning solution having a controlled amount of foaming. The low-foaming liquid detergent finds particular utility in open washing devices, such as those in the fast food industry, for cleaning the surface of dishes, flatware, and especially metal cookware.

Accordingly, the present invention is directed to an improved low-foaming liquid detergent comprising a balanced combination of components, which result in a cleaning solution having desired properties including, but not limited to, low, controlled foaming; suitable for use with aluminum cookware; dispensable as a liquid, either manually or automatically; and an acceptable shelf life.

The present invention is also directed to a method of making the improved low-foaming liquid detergent, and methods of using the low-foaming liquid detergent in open washing devices, such as POWER SOAK® potwashing devices.

These and other features and advantages of the present invention will become apparent after a review of the following detailed description of the disclosed embodiments and the appended claims.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the present invention is intended by the use of specific language. Alterations, further modifications, and such further applications of the principles of the present invention discussed are contemplated as would normally occur to one ordinarily skilled in the art to which the invention pertains.

The present invention is directed to a combination of ingredients, and those skilled in the art may find ways to alter that combination by means of further chemical additions to the solutions specifically disclosed and claimed. Moreover, the amounts set out in embodiments, and even the claims may be changed and still achieve the benefits of the present invention. Such modifications are considered to be within the scope of the present invention, as set out in the attached claims and their equivalents.

The present invention is directed to a low-foaming liquid detergent having a unique combination of components, which results in a cleaning solution having a controlled amount of foaming. The low-foaming liquid detergent contains a balanced combination of high-foaming surfactants and foam control agents in order to produce desired foaming properties. The combination of high-foaming surfactants and foam control agents enables intense agitation of a cleaning solution containing the low-foaming liquid detergent and water without forming an undesirable amount of foam, only a sufficient amount of foam to indicate effective cleaning.

I. Low-Foaming Liquid Detergent Component

The low-foaming liquid detergent of the present invention comprises a number of components, which provide desired characteristics to the resulting liquid detergent. A description of each class of liquid detergent component is given below.

A. Water

The low-foaming liquid detergent of the present invention comprises water as a primary solvent or carrier. Soft or hard water may be used in the present invention, although soft water is more desirable. As used herein, the term "soft water" refers to water containing less than about 60 ppm of calcium carbonate. As used herein, the term "hard water" refers to water containing more than about 60 ppm of calcium carbonate, while "very hard water" refers to water containing more than about 180 ppm of calcium carbonate. The low-foaming liquid detergent of the present invention may be formed using water available from any municipal water-treatment facility.

The low-foaming liquid detergent of the present invention typically comprises from about 45 to about 90 weight percent (wt %) of water based on a total weight of the low-foaming liquid detergent. Desirably, the low-foaming liquid detergent of the present invention comprises from about 60 to about 75 wt % water based on a total weight of the low-foaming washing detergent. In one desired embodiment of the present invention, the low-foaming liquid detergent comprises about 70 wt % water based on a total weight of the low-foaming washing detergent B. High-Foaming Surfactants The low-foaming liquid detergent of the present invention comprises one or more high-foaming surfactants. As used herein, the term "high-foaming surfactant" refers to a surfactant, which produces an excess amount of foam when subjected to agitation in a POWER SOAK® potwashing device without a foam control agent, wherein the "excessive amount" indicates foam overflowing an upper edge of the POWER SOAK® potwashing device. Typically, the distance from the water fill level to the upper edge of the POWER SOAK® potwashing device is about 8.9 cm. (3.5 inches). Incorporation of high-foaming surfactant into a water solution without a foam control agent increases the volume of the liquid and the liquid level during agitation, and eventually the liquid overflows onto the floor.

Suitable high-foaming surfactants for use in the present invention include, but are not limited to, anionic surfactants, nonionic surfactants, and amphoteric surfactants. Anionic surfactants include, but are not limited to, dodecyl benzene sulfonic acid and its salts, alkyl ether sulfates and salts thereof, olefin sulfonates, phosphate esters, soaps, sulfosuccinates, and alkyaryl sulfonates. Nonionic surfactants include, but are not limited to, alkoxylates of alkyl phenols and alcohols, alkanolamides, and amine oxides. Amphoteric surfactants include, but are not limited to, imidazoline derivatives, betaines, and amine oxides. Specific examples of suitable high-foaming surfactants include, but are not limited to, dodecyl benzene sulfonic acid and its salts, nonyl phenoxy ethoxylate, ethoxylated alcohol containing from about 9 to about 15 carbon atoms, diethanol coconut amide, sodium lauryl ether sulfate, and combinations thereof.

The low-foaming liquid detergent of the present invention comprises one or more high-foaming surfactants. In one desired embodiment of the present invention, the low-foaming liquid detergent comprises a combination of two or more high-foaming surfactants, wherein the high-foaming surfactants are selected from linear dodecyl benzene sulfonic acid, nonyl phenoxy ethoxylate, ethoxylated alcohol having from about 9 to about 15 carbon atoms, and diethanol coconut amide. In a further embodiment of the present invention, the low-foaming liquid detergent comprises a combination of high-foaming surfactants, wherein the combination comprises linear dodecyl benzene sulfonic acid, nonyl phenoxy ethoxylate, ethoxylated alcohol having from about 9 to about 15 carbon atoms, diethanol coconut amide, and sodium lauryl ether sulfate.

The low-foaming liquid detergent of the present invention may comprise one or more high-foaming surfactants in an amount of up to about 40 wt % based on a total weight of the low-foaming liquid detergent. Desirably, the one or more high-foaming surfactants are present in an amount ranging from about 5 to about 40 wt % based on a total weight of the low-foaming liquid detergent. More desirably, the one or more high-foaming surfactants are present in an amount ranging from about 15 to about 30 wt % based on a total weight of the low-foaming liquid detergent.

A number of commercially available high-foaming surfactants may be used in the present invention. Suitable commercially available linear dodecyl benzene sulfonic acid surfactants include, but are not limited to, surfactants sold under the trade designation BIOSOFT™, available from Stepan Chemical Company (Northfield, Ill.), such as BIOSOFT™ S-100; and surfactants sold under the trade designation WITCO, available from Witco Corporation (Greenwich Conn.), such as WITCO 1298 Soft Acid. Suitable commercially available nonyl phenoxy ethoxylate surfactants include, but are not limited to, surfactants sold under the trade designation SURFONIC®, available from Huntsman Chemical Company (Houston, Tex.), such as SURFONIC® N95; surfactants sold under the trade designation TERGITOL™, available from Dow Chemical Company (Midland, Mich.), such as TERGITOL™ 9.5; and surfactants sold under the trade designation MAKON®, available from Stepan Chemical Company (Northfield, Ill.), such as MAKON® 10. Suitable commercially available ethoxylated alcohols having from about 9 to about 15 carbon atoms include, but are not limited to, surfactants sold under the trade designation SURFONIC®, available from Huntsman Chemical Company (Houston, Tex.), such as SURFONIC® L12-6; and surfactants sold under the trade designation NEODOL®, available from Shell Chemical Co. (Houston, Tex.), such as NEODOL® 91-6. Suitable commercially available diethanol coconut amide surfactants include, but are not limited to, surfactants available under the trade designation NINOL, available from the, Stepan Chemical Company (Northfield, Ill.), such as NINOL 40-CO; surfactants sold under the trade designation STANDAMID™, available from Henkel, Canada Ltd. (Ontario, Canada), such as STANDAMID™ SD; and surfactants sold under the trade designation WITAMIDE, available from Witco Corporation (Greenwich, Conn.), such as WITAMIDE 82. Suitable commercially available sodium lauryl ether sulfate surfactants include, but are not limited to, surfactants that are sold under the trade designation SULFOTEX™ available from the Henkel Corporation (Cincinnati, Ohio), such as SULFOTEX™ NL-60S and SULFOTEX™ 60/40X; and surfactants sold under the trade designation STEOL™, available from Stepan Chemical Company (Northfield, Ill.), such as STEOL™ CS460.

C. Low-Foaming Surfactants

The low-foaming liquid detergent of the present invention may also include one or more low-foaming surfactants. As used herein, the term "low-foaming surfactant" refers to a surfactant, which does not produce an excess amount of foam when subjected to agitation in a POWER SOAK® potwashing device without a foam control agent (i.e., foam does not overflow an upper edge of the POWER SOAK® potwashing device as described above). Suitable low-foaming surfactants include, but are not limited to, ethoxylated alcohols having from about 6 to about 10 carbon atoms.

One or more low-foaming surfactants may be present in the low-foaming liquid detergent of the present invention in an amount of up to about 10.0 wt % based on a total weight of the low-foaming liquid detergent. Desirably, the low-foaming liquid detergent of the present invention comprises one or more low-foaming surfactants in an amount of from about 2.0 to about 8.0 wt % based on a total weight of the low-foaming liquid detergent. More desirably, the low-foaming liquid detergent comprises one or more low-foaming surfactants in an amount of from about 3.0 to about 4.0 wt % based on a total weight of the low-foaming liquid detergent.

Commercially available low-foaming surfactants may be selected from a variety of products including, but not limited to, surfactants sold under the trade designation POLY-TERGENT™, available from BASF Corporation (Charlotte, N.C.), such as POLY-TERGENT™ SLF-18; surfactants sold under the trade designation PLURONIC®, available from BASF Corporation (Mount Olive, N.J.), such as PLURONIC® L-61 block polymer; and surfactants sold under the trade designation TRITON™, available from Union Carbide Corporation (South Charleston, W.Va.), such as TRITON™ CF-32.

D. pH Control Agents

The low-foaming liquid detergent of the present invention contains one or more pH control agents in order to maintain a pH in a range of about 6.0 to about 10.5. Suitable pH control agents include, but are not limited to, inorganic pH control agents; organic pH control agents; and combinations thereof. Suitable inorganic pH control agents include, but are not limited to, alkali metal hydroxides, such as sodium hydroxide solution or potassium hydroxide solution, and water soluble carbonates or bicarbonates. Suitable organic pH control agents include, but are not limited to, triethanolamine (TEA), monoethanolamine, isopropanolamine, and aminomethyl propanol. Desirably, the pH control agent is sodium hydroxide solution, TEA, or a combination thereof.

The low-foaming liquid detergent of the present invention contains one or more pH control agents in an amount necessary to obtain a pH in the range of about 6.0 to about 10.5. Typically, the one or more pH control agents are present in an amount ranging from about 3.0 to about 5.0 wt % of the low-foaming liquid detergent based on a total weight of the low-foaming liquid detergent; however, this amount will vary depending on the actual amount of acidic materials used in the low-foaming liquid detergent. In one embodiment of the present invention, the low-foaming liquid detergent of the present invention comprises about 3.5 wt % of a sodium hydroxide solution (50 wt % NaOH in water) alone or in combination with about 0.5 wt % of TEA, wherein the weight percents are based on a total weight of the low-foaming liquid detergent. It should be noted that other sodium hydroxide solutions having different concentrations may be used in the present invention.

Commercially available pH control agents include, but are not limited to, Caustic Soda 50%, Rayon grade, available from PPG Industries (Pittsburgh, Pa.) or any other major manufacturer of sodium hydroxide liquid, such as ICI Americas, Inc. (Wilmington, Del.); and TEA, available from Dow Chemical Company (Midland, Mich.) or any other major manufacturer, such as Huntsman Corp. (Houston, Tex.).

E. Viscosity Control Agents

The low-foaming liquid detergent of the present invention may include one or more viscosity control agents in an amount of up to about 10 wt % based on a total weight of the low-foaming liquid detergent. Suitable viscosity control agents include, but are not limited to, magnesium sulfate, hexahydrate powder or magnesium sulfate solution (i.e., magnesium sulfate in an aqueous solution); acrylic polymer; alcohols such as isopropyl alcohol and ethyl alcohol; cellulose derivatives such as hydroxymethyl or hydroxypropyl cellulose; and combinations thereof. One example of a suitable salt solution for use in the present invention is a magnesium sulfate solution 27% (i.e., 27 wt % magnesium sulfate in an aqueous solution). Other magnesium sulfate solutions having a different concentration may be used in the present invention, as well as, other salt powders and other salt solutions.

Commercially available viscosity control agents include, but are not limited to, a magnesium sulfate 27% liquid solution sold under the trade designation EPSON LIQUID 27%, available from Giles Chemical Corporation (Waynesville, N.C.); and acrylic polymers sold under the trade designation ACUSOL®, available from Rohm and Haas (Glen Allen, Va.), such as ACUSOL® 820 and ACUSOL® 880; and acrylic polymers sold under the trade designation GOODRITE™, available from B. F. Goodrich Specialty Chemicals (Cleveland, Ohio), such as GOODRITE™ K 7058.

F. Foam-Control Agents

The low-foaming liquid detergent of the present invention contains at least one foam-control agent. Suitable foam-control agents include, but are not limited to, silicones such as polydimethyl siloxanes, silanols derived from silanes, perfluorinated acids, and combinations thereof. Any of the above-mentioned foam-control agents may further include silica particles and other materials such as mineral oils. Examples of possible mineral oils include, but are not limited to, KLEAROL™ White mineral oil available from Crompton Corporation (Petrolia, Pa.) and ISOPAR™ M mineral oil available from ExxonMobil (Houston, Tex.).

The low-foaming liquid detergent may comprise one or more foam-control agents, typically in an amount of up to about 2.5 wt % based on a total weight of the low-foaming liquid detergent. In one desired embodiment of the present invention, the low-foaming liquid detergent comprises from about 0.01 to about 2.0 wt % of one or more foam-control agents, based on a total weight of the low-foaming liquid detergent. When the foam-control agent is present in the form of a solution, the active ingredient (e.g., the silicone component) is typically present in an amount of up to about 100.0 wt % based on a total weight of the foam-control agent solution. Consequently, the amount of active foam-control agent is typically present in the low-foaming liquid detergent in an amount of up to about 2.0 wt % based on a total weight of the low-foaming liquid detergent, more typically, about 0.01 to about 0.15 wt % based on a total weight of the low-foaming liquid detergent.

Commercially available foam-control agents suitable for use in the present invention include, but are not limited to, foam control agents sold under the trade designation FOAM BLAST®, available from Ross Chemical Company (Fountain Inn, S.C.), such as FOAM BLAST® 552; foam control agents available from Harcross Chemicals (Kansas City, Mo.), such as Harcross Silicone AF-10 FG; foam control agents available from Dow Corning Corp. (Midland, Mich.), such as Dow Corning 1510 Silicone; and foam control agents sold under the trade designation FLUOWET®, available from Clariant Corp. (Charlotte, N.C.), such as FLUOWET® PL-80.

In one desired embodiment of the present invention, the low-foaming liquid detergent contains up to about 2.0 wt % of FOAM BLAST® 552 based on a total weight of the low-foaming liquid detergent. FOAM BLAST® 552 is a proprietary mixture containing hydrophobic silica, ethylene oxide/propylene oxide copolymer, silanols derived from silanes, and small amounts of nonionic surfactants.

C. Co-solvents

The low-foaming liquid detergent of the present invention may also include one or more co-solvents in an amount of up to about 10 wt % of a total weight of the low-foaming liquid detergent. Suitable co-solvents include, but are not limited to, glycols, glycol ethers, and combinations thereof. Specific examples of co-solvents include, but are not limited to, glycols, such as hexylene glycol, propylene glycol, or a mixture of two or more glycols; butyl carbitol; dipropylene glycol methyl ether; and dipropylene glycol normal butyl ether; and mixtures thereof. In one desired embodiment of the present invention, the low-foaming liquid detergent of the present invention comprises one or more co-solvents in an amount of from about 1 to about 5 wt % based on a total weight of the low-foaming liquid detergent. Desirably, the one or more co-solvents comprises hexylene glycol.

Commercially available co-solvents include, but are not limited to, hexylene glycol available from Union Carbide Corp. (Danbury, Conn.); propylene glycol available from Dow Chemical Co. (Midland, Mich.); and butyl carbitol available from Union Carbide Corp. (Danbury, Conn.).

H. Additives

The low-foaming liquid detergent of the present invention may contain one or more additives to provide a desired characteristic to the low-foaming liquid detergent. Suitable additives include, but are not limited to, dyes, pigments, perfumes, preservatives, and combinations thereof. In one desired embodiment of the present invention, the low-foaming liquid detergent comprises at least one dye to provide a desirable color, at least one perfume to provide a desirable scent, and at least one preservative to prevent bacterial growth within the low-foaming liquid detergent.

Typically, additives such as dyes, perfumes, and preservatives, are each individually present in an amount of less than about 0.1 wt % based on a total weight of the low-foaming liquid detergent. Desirably, the amount of dye in the low-foaming liquid detergent, when present, ranges from about 0.0005 to about 0.01 wt % based on a total weight of the low-foaming liquid detergent. When a perfume is present, the amount of perfume is desirably from about 0.01 to about 0.1 wt % based on a total weight of the low-foaming liquid detergent. Desirably, one or more preservatives are present in the low-foaming liquid detergent in an amount ranging from about 0.001 to about 0.01 wt % based on a total weight of the low-foaming liquid detergent.

A number of commercially available additives may be used in the present invention. Commercially available dyes suitable for use in the present invention include, but are not limited to, Blue Pylaklor LX 10092 available from Pylam Products (Tempe, Ariz.); Resorcine Brown 5GM available from Pylam Products (Tempe, Ariz.); and Tartrazine Yellow available from Chemcentral (Romulus, Mich.). Commercially available perfumes suitable for use in the present invention include, but are not limited to, perfume SZ-6929 (Apple) available from J. E. Sozio, Inc. (Edison, N.J.); Citrus SZ-6242 available from J. E. Sozio, Inc. (Edison, N.J.); and MF 3773 (lemon) available from Mane, USA (Wayne, N.J.). Commercially available preservatives suitable for use in the present invention include, but are not limited to, preservatives sold under the trade designation UCARCIDE™, available from (Union Carbide Corp., Danbury, Conn.), such as UCARCIDE™ 250.

II. Method of Making the Low-Foaming Washing Liquid

The low-foaming liquid detergent of the present invention may be prepared using conventional mixing techniques at room temperature. When a high viscosity, low-foaming liquid detergent is prepared, the components are desirably combined in the following order while mixing: water, viscosity control agents, pH control agents, surfactants, co-solvents, foam control agents, and then additives such as perfumes, dyes and preservatives. As used herein, the term "high viscosity" refers to a solution having a viscosity of greater than or equal to about 150 centipoise (cps). Typically, a high viscosity low-foaming liquid detergent of the present invention has a viscosity ranging from about 150 cps to about 450 cps. As used herein, the term "low viscosity" refers to a solution having a viscosity of less than about 150 cps. Typically, a low viscosity low-foaming liquid detergent of the present invention has a viscosity ranging from about 30 cps to less than about 150 cps.

When a low viscosity, low-foaming liquid detergent is prepared, the components are desirably combined in the following order while mixing: water, pH control agents, surfactants, co-solvents, viscosity control agents, foam control agents, and then additives such as perfumes, dyes and preservatives.

III. Methods of Using the Low-Foaming Washing Liquid

The low-foaming liquid detergent of the present invention may be used in a variety of applications including, but not limited to, household, commercial, and industrial applications. The low-foaming washing liquid detergent of the present invention is particularly suitable for use with open washing devices, such as POWER SOAK® potwashing systems available from MetCraft Corporation (Grandview, Mo.), as well as other pot and pan washing systems, such as those disclosed in U.S. Pat. No. 4,773,436, assigned to Cantrell Industries, Inc. (Olathe, Kans.), the subject matter of which is hereby incorporated by reference. Suitable MetCraft POWER SOAK® potwashing systems include, but are not limited to, the MetCraft MX-220-H POWER SOAK® Potwashing System.

One desired method of use the low-foaming liquid detergent of the present invention is in the custom food service industry. Fast food service companies desire a cleaning system, which may be used throughout a given workday (i.e., 12 hours or more per day). In one method of the present invention, a desired amount of the low-foaming liquid detergent is added to a MetCraft POWER SOAK® Potwashing System. Desirably, the amount of low-foaming liquid detergent ranges from about 1.0 cc (0.03 oz.) to about 5.0 cc (0.17 oz) of low-foaming liquid detergent per gallon of water. The POWER SOAK® Potwashing System is filled with water at a desired temperature, typically from about 43.3° C. (110° F.) to about 46.1° C. (115° F.), to an operating level (typically about 8.9 cm. (3.5 inches) from an upper edge of the POWER SOAK® potwashing device) and the water-agitation mechanism of the POWER SOAK® apparatus is initiated. Pots and other food-preparation items are typically soaked in the POWER SOAK® Potwashing System for a period of up to four hours. The pots and/or food-preparation items are then removed from the low-foaming liquid detergent, rinsed and sanitized prior to use.

In one embodiment of the present invention, a method of washing dishes, pots, or other food-preparation items comprises soaking the items in a POWER SOAK® Potwashing System, wherein the soaking solution comprises a low-foaming liquid detergent having a composition as shown in Table 1 below.

TABLE 1

Exemplary Low Foaming Liquid Detergent Formulations

| Chemical Component | Desired Range (wt %) | More Desired Range (wt %) |
|---|---|---|
| water | ~40.0 to ~70.0 | ~50.0 to ~60.0 |
| sodium hydroxide, 50% | up to ~6.0 | ~3.0 to ~4.0 |
| linear dodecyl benzene sulfonic acid | ~5.0 to ~20.0 | ~14.5 to ~15.5 |
| magnesium sulfate 27% liquid | ~6.0 to ~9.0 | ~7.5 to ~8.5 |
| triethanolamine, 85% | up to ~6.0 | ~0.3 to ~0.6 |
| nonyl phenoxy (9.5 mole) ethoxylate | up to ~10.0 | ~3.5 to ~4.5 |
| ethoxylated alcohol C10–12 | up to ~10.0 | ~3.5 to ~4.5 |
| ethoxylated alcohol | up to ~10.0 | ~3.5 to ~4.5 |
| diethanol coconut amide | up to ~5.0 | ~1.5 to ~2.5 |
| blue dye | up to ~0.01 | ~0.0005 to ~0.0015 |
| perfume | up to ~0.1 | ~0.05 to ~0.06 |
| preservative | up to ~0.10 | ~0.0040 to ~0.0060 |
| foam control agent | up to ~4.0 | ~1.0 to ~2.0 |
| hexylene glycol | up to ~10.0 | ~2.5 to ~3.5 |

In a further embodiment of the present invention, a method of washing dishes, pots, or other food-preparation items comprises soaking the items in a POWER SOAK® Potwashing System, wherein the soaking solution comprises a low-foaming liquid detergent having a composition as shown in Table 2 below.

TABLE 2

Exemplary Low Foaming Liquid Detergent Formulations

| Chemical Component | Desired Range (wt %) | More Desired Range (wt %) |
|---|---|---|
| water | ~50.0 to ~75.0 | ~60.0 to ~65.0 |
| acrylic polymer | up to ~2.0 | ~0.20 to ~0.28 |
| sodium hydroxide, 50% | up to ~6.0 | ~3.5 to ~4.5 |
| nonyl phenoxy (9.5 mole) ethoxylate | up to ~10.0 | ~3.5 to ~4.5 |
| ethoxylated alcohol C10–12 | up to ~10.0 | ~3.5 to ~4.5 |
| ethoxylated alcohol C6–10 | up to ~10.0 | ~2.5 to ~3.5 |
| linear dodecyl benzene sulfonic acid | ~5.0 to ~20.0 | ~14.0 to ~16.0 |
| diethanol coconut amide | up to ~5.0 | ~1.5 to ~2.5 |
| sodium lauryl ether sulfate | up to ~10.0 | ~4.5 to ~5.5 |
| preservative | up to ~0.10 | ~0.003 to ~0.008 |
| blue dye | up to ~0.1 | ~0.0005 to ~0.0015 |
| perfume | up to ~0.15 | ~0.05 to ~0.08 |
| foam control agent | up to ~4.0 | ~0.10 to ~0.16 |

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLES

The materials shown in Table 1 are used in the examples below.

TABLE 1

Chemicals Used In Examples

| Material | Description | Manufacturer |
|---|---|---|
| High-Foaming Sufactants | | |
| BIOSOFT ™ S-100 | linear dodecyl benzene sulfonic acid | Stepan Chemical Company Northfield, Illinois |
| NINOL ™ 40-CO | diethanol coconut amide | Stepan Chemical Company Northfield, Illinois |
| STANDAMID ™ SD | diethanol coconut amide | Cognis Corporation Cincinnati, OH |
| STEOL ® CS460 | sodium lauryl ether sulfate | Stepan Chemical Company Northfield, Illinois |
| SURFONIC ® L12-6 | ethoxylated alcohol having $C_{10-12}$ moieties, | Huntsman Corp. Houston, TX |
| SURFONIC ® N95 | nonyl phenoxy (9.5 mole) ethoxylate | Huntsman Corp., Houston, TX |
| SULFOTEX ® 6040X | sodium lauryl ether sulfate, a high-foaming surfactant | Cognis Corporation Cincinnati, OH |
| SULFOTEX ® NL-60S | sodium lauryl ether sulfate, a high-foaming surfactant | Cognis Corporation Cincinnati, OH |
| TERGITOL ® 9.5 | nonyl phenoxy (9.5 mole) ethoxylate | Union Carbide Corporation Danbury, CT |
| Low-Foaming Surfactants | | |
| Poly-Tergent ™ SLF-18 | ethoxylated alcohol, a low-foaming surfactant | BASF Corporation Charlotte, NC |
| Foam Control Agents | | |
| FOAM BLAST ® 552 | silica-glycol copolymer foam control agent | Ross Chemical Company Fountain Inn, SC |
| pH Control Agents | | |
| Caustic Soda 50% Rayon grade | sodium hydroxide, 50% solution, a pH control agent | PPG Industries Pittsburgh, PA |
| TEA | triethanolamine, 85% | Dow Chemical Company Midland, MI |
| Viscosity Control Agents | | |
| ACUSOL ® 820 | acrylic polymer | Rohm & Haas, Glen Allen, VA |
| Epson Liquid 27% | magnesium sulfate solution, 27 wt % | Giles Chemical Corp. Waynesville, NC |
| Co-solvents | | |
| hexylene glycol | hexylene glycol | Union Carbide Corporation Danbury, CT |
| Preservatives | | |
| UCARCIDE ™ 250 | preservative (biocide) | Union Carbide Corporation Danbury, CT |
| Colorants | | |
| Blue Pylaklor LX 10092 | dye | Pylam Products Tempe, AZ |

TABLE 1-continued

| Chemicals Used In Examples | | |
|---|---|---|
| Material | Description | Manufacturer |
| Perfumes | | |
| SZ 6949, Apple | perfume | J.E. Sozio, Inc. Edison, NJ |

EXAMPLE 1

Preparation of a Low Viscosity Low Foaming Washing Liquid

A low viscosity, low foaming washing liquid detergent was prepared having the formulation as shown in Table 4 below and a total solution weight of 100 kilograms (kg.).

TABLE 4

| Low Viscosity, Low Foaming Washing Liquid | | | |
|---|---|---|---|
| Chemical Name | Chemical Component | Net. Wt. | Wt % |
| Water | water, City of Greensboro, NC | 54.4245 kg | 54.4245 |
| Caustic Soda 50% DIAPH LQ | sodium hydroxide, 50% | 3.5164 kg | 3.5164 |
| BIOSOFT ™ S-100 | linear dodecyl benzene sulfonic acid | 14.9847 kg | 14.9847 |
| Epson Liquid 27% | magnesium sulfate 27% liquid | 7.9918 kg | 7.9918 |
| TEA | triethanolamine, 85% | 0.5195 kg | 0.5195 |
| SURFONIC ® N95 | nonyl phenoxy (9.5 mole) ethoxylate | 3.9959 kg | 3.9959 |
| SURFONIC ® L12-6 | ethoxylated alcohol C10–12 | 3.9959 kg | 3.9959 |
| Poly-Tergent ™ SLF-18 | ethoxylated alcohol | 3.9959 kg | 3.9959 |
| NINOL ™ 40-CO | diethanol coconut amide | 1.9980 kg | 1.9980 |
| Blue Pylaklor LX 10092 | blue dye | 1.0 g | 0.0010 |
| SZ 6949, Apple | perfume | 55.9 g | 0.0559 |
| UCARCIDE ™ 250 | preservative | 5.0 g | 0.0050 |
| FOAM BLAST ® 552 | silica-glycol copolymer foam control agent | 1.5185 kg | 1.5185 |
| Hexylene Glycol | hexylene glycol | 2.9969 kg | 2.9969 |

The resulting composition had a viscosity of about 77.5 cps.

About 165 grams of the washing liquid was poured into a POWER SOAK® potwashing device from Metcraft, Inc. (Grandview, Mo.), Model No. MX-220-H, having a solution capacity of about 54 gallons. The device was filled with water to the fill line, approximately 8.26 cm (3.25 in.) from an upper rim of the device. About 50 grams of a typical food soil, such as chicken grease, was added to mimic conditions in the field. Agitation was initiated, and continued for a period of 4 hours.

A desirable amount of foam was observed continuously throughout the 4 hour period. The foam remained inside the boundaries of the potwashing device without overflowing onto the floor.

EXAMPLE 2

Preparation of a High Viscosity Low Foaming Washing Liquid

A high viscosity, low foaming washing liquid detergent was prepared having the formulation as shown in Table 5 below and a total solution weight of 100 kilograms (kg).

TABLE 5

| High Viscosity, Low Foaming Washing Liquid | | | |
|---|---|---|---|
| Chemical Name | Chemical Component | Net. Wt. | Wt % |
| Water | water, City of Greensboro, NC | 62.6824 kg | 62.6824 |
| ACUSOL ® 820 | acrylic polymer | 245.8 g | 0.2458 |
| Caustic Soda 50% DIAPH LQ | sodium hydroxide, 50% | 3.9945 kg | 3.9945 |
| SULFONIC ® N95 | nonyl phenoxy (9.5 mole) ethoxylate | 4.0016 kg | 4.0016 |
| SURFONIC ® L12-6 | ethoxylated alcohol C10–12 | 4.0016 kg | 4.0016 |
| Poly-Tergent ™ SLF-18 | ethoxylated alcohol | 3.0782 kg | 3.0782 |
| BIOSOFT ™ S-100 | linear dodecyl benzene sulfonic acid | 14.9291 kg | 14.9291 |
| NINOL ™ 40-CO | diethanol coconut amide | 2.0008 kg | 2.0008 |
| STEOL ® CS460 | sodium lauryl ether sulfate | 4.9251 kg | 4.9251 |
| UCARCIDE ™ 250 | preservative | 5.0 g | 0.0050 |
| Blue Pylaklor LX 10092 | blue dye | 1.0 g | 0.0010 |
| SZ 6949, Apple | perfume | 61.6 g | 0.0616 |
| FOAM BLAST ® 552 | silica-glycol copolymer foam control agent | 130.6 g | 0.1306 |

The resulting composition had a viscosity of about 320 cps.

About 164 grams of the washing liquid was poured into a POWER SOAK® potwashing device from Metcraft, Inc. (Grandview, Mo.), Model No. MX-220-H, having a solution capacity of about 54 gallons. The device was filled with water to the fill line, approximately 8.26 cm (3.25 in.) from an upper rim of the device. About 50 grams of a typical food soil, such as chicken grease, was added to mimic conditions in the field. Agitation was initiated, and continued for a period of 4 hours.

A desirable amount of foam was observed continuously throughout the 4 hour period. The foam remained inside the boundaries of the potwashing device without overflowing onto the floor.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A low-foaming, liquid detergent comprising:

water;

a combination of high-foaming surfactants, wherein the combination includes linear dodecyl benzene sulfonic acid in an amount of up to about 20.0 wt % nonyl phenoxy ethoxylate in an amount of up to about 10.0 wt %, and an ethoxylated alcohol containing from about 9 to about 15 carbon atoms in an amount of up to about 10.0 wt %;

at least one pH control agent in a total amount to provide a pH ranging from about 6.0to about 10.5; and at least one foam control agent;

wherein all weight percentages are based on a total weight of the low-foaming, liquid detergent composition.

2. The detergent of claim 1, wherein the detergent further comprises one or more high-foaming surfactants selected from diethanol coconut amide, sodium lauryl ether sulfate, and combinations thereof.

3. The detergent of claim 1, wherein the detergent comprises one or more pH control agents selected from sodium hydroxide, potassium hydroxide, triethanolamine, and combinations thereof.

4. The detergent of claim 1, wherein the detergent comprises one or more foam control agents, wherein the one or more foam control agents comprises at least one silicone such as polydimethyl siloxanes, silanol derived from a silane, or perfluorinated acid; and at least one component selected from silica particles, mineral oil, hydrophobic silica, ethylene oxide/propylene oxide copolymer, and non-ionic surfactant.

5. The detergent of claim 1, further comprising at least one low-foaming surfactant selected from ethoxylated alcohols having from about 6 to about 10 carbon atoms.

6. The detergent of claim 1, further comprising one or more viscosity control agents selected from a magnesium sulfate 27% liquid solution, an acrylic polymer, isopropyl alcohol, ethyl alcohol, and combinations thereof.

7. The detergent of claim 1, further comprising one or more co-solvents selected from hexylene glycol, propylene glycol, butyl carbitol, dipropylene glycol methyl ether, dipropylene glycol normal butyl ether, and combinations thereof.

8. The detergent of claim 1, further comprising one or more additives selected from a dye, a perfume, a preservative, and combinations thereof.

9. The detergent of claim 1, wherein the detergent comprises a composition containing:

water in an amount ranging from about 40.0 to about 70.0 wt %;

linear dodecyl benzene sulfonic acid in an amount ranging from about 5.0 to about 20.0 wt %, and an ethoxylated alcohol having from ten to twelve carbon atoms therein in an amount of up to about 10.0 wt %;

wherein the at least one pH control agent comprises (i) sodium hydroxide, 50% solution, in an amount of up to about 6.0 wt %, and (ii) triethanolamine, 85%, in an amount of up to about 6.0 wt %; and wherein the detergent further comprises:

magnesium sulfate 27% liquid solution in an amount ranging from about 6.0 to about 9.0 wt %;

an ethoxylated alcohol having from 6 to 10 carbon atoms therein in an amount of up to about 10.0 wt %;

diethanol coconut amide in an amount of up to about 5.0 wt %;

a dye in an amount of up to about 0.01 wt %, a perfume in an amount of up to about 0.1 wt %;

a preservative in an amount of up to about 0.10 wt %;

a foam control agent in an amount of up to about 4.0 wt %; and hexylene glycol in an amount of up to about 10.0 wt %;

wherein all weight percentages are based on a total weight of the low-foaming, liquid detergent composition.

10. The detergent of claim 9, wherein the detergent comprises a composition containing:

water in an amount ranging from about 50.0 to about 60.0 weight percent (wt %);

sodium hydroxide, 50% solution, in an amount ranging from about 3.0 to about 4.0 wt %;

linear dodecyl benzene sulfonic acid in an amount ranging from about 14.5 to about 15.5 wt %;

magnesium sulfate 27% liquid solution in an amount ranging from about 7.5 to about 8.5 wt %;

triethanolamine, 85%, in an amount ranging from about 0.3 to about 0.6 wt %;

nonyl phenoxy ethoxylate in an amount ranging from about 3.5 to about 4.5 wt %;

an ethoxylated alcohol having from ten to twelve carbon atoms therein in an amount ranging from about 3.5 to about 4.5 wt %;

an ethoxylated alcohol having from 6 to 10 carbon atoms therein in an amount ranging from about 3.5 to about 4.5 wt %;

diethanol coconut amide in an amount ranging from about 1.5 to about 2.5 wt %;

a dye in an amount of up to about 0.01 wt %;

a perfume in an amount of up to about 0.1 wt %;

a preservative in an amount of up to about 0.10 wt %;

a foam control agent in an amount ranging from about 1.0 to about 2.0 wt %; and hexylene glycol in an amount ranging from about 2.5 to about 3.5 wt %;

wherein all weight percentages are based on a total weight of the low-foaming, liquid detergent composition.

11. The detergent of claim 1, wherein the detergent comprises a composition containing:

water in an amount ranging from about 50.0 to about 75.0 wt %;

linear dodecyl benzene sulfonic acid in an amount ranging from about 5.0 to about 20.0 wt %; and an ethoxylated alcohol having from ten to twelve carbon atoms therein in an amount of up to about 10.0 wt %;

wherein the at least one pH control agent comprises sodium hydroxide, 50% solution, in an amount of up to about 6.0 wt %; and wherein the detergent further comprises:

an acrylic polymer in an amount of up to about 2.0 wt %;

an ethoxylated alcohol having from 6 to 10 carbon atoms therein in an amount of up to about 10.0 wt %;

diethanol coconut amide in an amount of up to about 5.0 wt %;

sodium lauryl ether sulfate in an amount of up to about 10.0 wt %;

a preservative in an amount of up to about 0.10 wt %;

a dye in an amount of up to about 0.10 wt %;

a perfume in an amount of up to about 0.15 wt %; and a foam control agent in an amount of up to about 4.0 wt %;

wherein all weight percentages are based on a total weight of the low-foaming, liquid detergent composition.

12. The detergent of claim 1, wherein the detergent comprises a composition containing:

water in an amount ranging from about 60.0 to about 65.0 wt %;

nonyl phenoxy ethoxylate in an amount ranging from about 3.5 to about 4.5 wt %;

an ethoxylated alcohol having from ten to twelve carbon atoms therein in an amount ranging from about 3.5 to about 4.5 wt %; and linear dodecyl benzene sulfonic acid in an amount ranging from about 14.0 to about 16.0 wt %;

wherein the at least one pH control agent comprises sodium hydroxide, 50% solution, in an amount ranging from about 3.5 to about 4.5 wt %; and wherein the detergent further comprises:

an acrylic polymer in an amount ranging from about 0.20 to about 0.28 wt %;

an ethoxylated alcohol having from 6 to 10 carbon atoms therein in an amount ranging from about 2.5 to about 3.5 wt %;

diethanol coconut amide in an amount ranging from about 1.5 to about 2.5 wt %, sodium lauryl ether sulfate in an amount ranging from about 4.5 to about 5.5 wt %;

a preservative in an amount of up to about 0.10 wt %;

a dye in an amount of up to about 0.10 wt %;

a perfume in an amount of up to about 0.15 wt %; and a foam control agent in an amount of up to about 4.0 wt %;

wherein all weight percentages are based on a total weight of the low-foaming, liquid detergent composition.

13. The detergent of claim 1, wherein the detergent has a viscosity in a range of from about 275 to about 375 centipoise.

14. A cleaning solution comprising the detergent of claim 1 and water, wherein the cleaning solution comprises from about 1.0 to about 5.0 grams of detergent per gallon of water.

15. A low-foaming, liquid detergent comprising:

water in an amount ranging from about 40.0 to about 75.0 weight percent (wt %);

linear dodecyl benzene sulfonic acid in an amount ranging from about 5.0 to about 20.0 wt %;

diethanol coconut amide in an amount ranging from greater than 0 to about 5.0 wt %;

nonyl phenoxy ethoxylate in an amount ranging from greater than 0 to about 10.0 wt %;

an ethoxylated alcohol having from ten to twelve carbon atoms therein in an amount ranging from greater than 0 to about 10.0 wt %;

sodium lauryl ether sulfate in an amount of up to about 10.0 wt %;

an ethoxylated alcohol having from 6 to 10 carbon atoms therein in an amount ranging from greater than 0 to about 10.0 wt %;

at least one pH control agent in a total amount to provide a pH ranging from about 6.0 to about 10.5; and at least one foam control agent in an amount of up to about 4.0 wt %;

wherein all weight percentages are based on a total weight of the low-foaming, liquid detergent.

16. The detergent of claim 15, wherein the detergent comprises:

diethanol coconut amide in an amount ranging from about 1.5 to about 2.5 wt %;

nonyl phenoxy ethoxylate in an amount ranging from about 3.5 to about 4.5 wt %;

an ethoxylated alcohol having from ten to twelve carbon atoms therein in an amount ranging from about 3.5 to about 4.5 wt %; and an ethoxylated alcohol having from 6 to 10 carbon atoms therein in an amount ranging from about 3.5 to about 4.5 wt %;

wherein all weight percentages are based on a total weight of the low-foaming, liquid detergent.

17. The detergent of claim 16, wherein the detergent further comprises:

magnesium sulfate 27% liquid solution in an amount ranging from about 6.0 to about 9.0 wt %;

a dye in an amount of up to about 0.01 wt %;

a perfume in an amount of up to about 0.1 wt %;

a preservative in an amount of up to about 0.10 wt %; and hexylene glycol in an amount ranging from about 2.5 to about 3.5 wt %;

wherein all weight percentages are based on a total weight of the low-foaming, liquid detergent.

18. The detergent of claim 16, wherein the detergent further comprises:

sodium lauryl ether sulfate in an amount ranging from about 4.5 to about 5.5 wt %;

a dye in an amount of up to about 0.01 wt %;

a perfume in an amount of up to about 0.1 wt %; and a preservative in an amount of up to about 0.10 wt %;

wherein all weight percentages are based on a total weight of the low-foaming, liquid detergent.

19. A method of washing cookware, wherein the method comprises:

combining a liquid detergent and water into a power soaking potwashing sink to form a cleaning solution, wherein from about 1.0 to about 5.0 grams of the detergent is used per gallon of water, wherein the liquid detergent comprises:

water;

a combination of high-foaming surfactants, wherein the combination includes linear dodecyl benzene sulfonic acid in an amount of up to about 20.0 wt %, nonyl phenoxy ethoxylate in an amount of up to about 10.0 wt %, and an ethoxylated alcohol containing from about 9 to about 15 carbon atoms in an amount of up to about 10.0 wt %, wherein all weight percentages are based on a total weight of the low-foaming, liquid detergent composition;

at least one pH control agent; and at least one foam control agent;

agitating the cleaning solution by activating a built-in agitator within the power soaking potwashing sink;

placing the cookware into the power soaking potwashing sink;

removing the cookware from the cleaning solution; and rinsing the cookware;

wherein agitation of the cleaning solution by the agitator within the power soaking potwashing sink produces sufficient foam to indicate effective cleaning without producing excessive foam.

20. A system for washing cookware comprising:

a sink having a built-in agitator;

a cleaning solution within the sink, wherein the cleaning solution comprises:

water;

a combination of high-foaming surfactants, wherein the combination includes linear dodecyl benzene sulfonic acid in an amount of up to about 20.0 wt %, nonyl phenoxy ethoxylate in an amount of up to about 10.0 wt %, and an ethoxylated alcohol containing from about 9 to about 15 carbon atoms in an amount of up to about 10.0 wt %;

at least one pH control agent in a total amount to provide a pH ranging from about 6.0 to about 10.5; and at least one foam control agent in an amount of up to about 4.0 wt %;

wherein all weight percentages are based on a total weight of the low-foaming, liquid detergent; and wherein agitation of the cleaning solution by the agitator within the sink produces sufficient foam to indicate effective cleaning without producing excessive foam.

* * * * *